US008596313B2

(12) United States Patent
Le Roi

(10) Patent No.: US 8,596,313 B2
(45) Date of Patent: Dec. 3, 2013

(54) DEVICE AND METHOD FOR FILLING FOOD POTS

(75) Inventor: Paul Le Roi, Ris-Orangis (FR)

(73) Assignee: A.R.C.I.L., Puiseux Pontoise (FR)

( * ) Notice: Subject to any disclaimer, the term of this patent is extended or adjusted under 35 U.S.C. 154(b) by 827 days.

(21) Appl. No.: 12/652,960

(22) Filed: Jan. 6, 2010

(65) Prior Publication Data

US 2010/0170592 A1 Jul. 8, 2010

(30) Foreign Application Priority Data

Jan. 6, 2009 (EP) ..... 09290006

(51) Int. Cl.
*B65B 37/00* (2006.01)

(52) U.S. Cl.
USPC ..... 141/237; 141/90; 141/99; 141/105; 141/186; 141/374; 222/548

(58) Field of Classification Search
USPC ..... 222/548–550; 141/99, 105, 186, 237, 141/251, 258–260, 263, 284, 90, 374
See application file for complete search history.

(56) References Cited

U.S. PATENT DOCUMENTS

| | | | | |
|---|---|---|---|---|
| 3,561,505 | A * | 2/1971 | Ryder | 141/237 |
| 3,744,538 | A * | 7/1973 | Nasica et al. | 141/242 |
| 4,350,187 | A * | 9/1982 | Trusselle et al. | 141/90 |
| 5,529,099 | A | 6/1996 | Janek et al. | |
| 6,223,949 | B1 * | 5/2001 | Spencer et al. | 222/140 |
| 6,585,013 | B2 * | 7/2003 | Gamberini | 141/146 |
| 2005/0173469 | A1 | 8/2005 | Lingenhoff | |
| 2005/0224522 | A1 | 10/2005 | Lingenhoff | |
| 2008/0041490 | A1 * | 2/2008 | Togni | 141/105 |

FOREIGN PATENT DOCUMENTS

| | | |
|---|---|---|
| DE | 202 06 064 | 8/2003 |
| EP | 0582 955 | 2/1994 |
| EP | 1 494 921 | 1/2005 |

OTHER PUBLICATIONS

Search Report from Application No. EP 09 29 0006 dated Jun. 9, 2009.

* cited by examiner

*Primary Examiner* — Jason K Niesz
(74) *Attorney, Agent, or Firm* — Alston & Bird LLP

(57) ABSTRACT

The invention relates to a device (1) for filling food pots (2), for example yoghurt pots, comprising a plurality of nozzles (10) for filling the pots with a food product, said nozzles (10) each being mounted in a nozzle body (30), characterized in that the device comprises means for applying to each of the nozzles (10) a translational movement along the axis (A) of the nozzle, optionally combined with a rotational movement about this axis, independently of the nozzle body (30), in such a way that the same nozzle (10) can both carry out the filling action and stop the filling.
The invention also relates to a method for filling food pots using a device of this type.

17 Claims, 5 Drawing Sheets

DEVICE AND METHOD FOR FILLING FOOD POTS

FIELD OF THE INVENTION

Figure 1B:
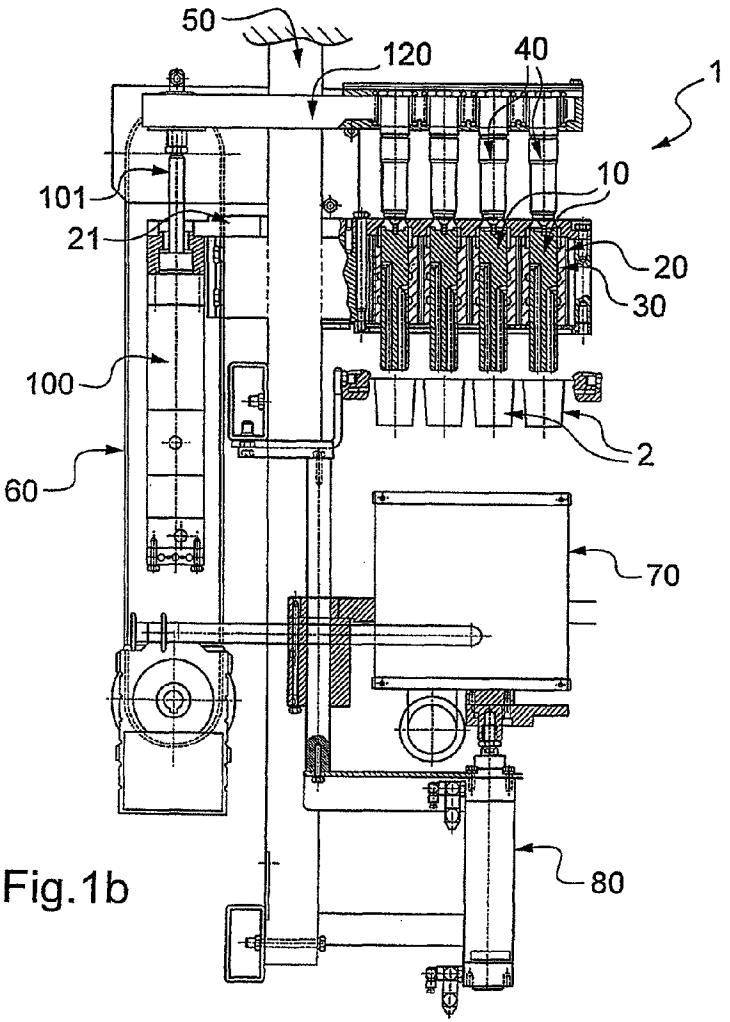

The invention relates to the field of devices for filling food pots, for example yoghurts.

In particular, the invention relates to the filling of pots with steamed, brewed, liquid or whipped cream, mousse-type liquid or fluid products, syrups, honey, caramel or else with dry or granular products.

For example, whipped cream-based products are found in the upper portion of a café liégeois ice cream in the form of an upward twirl. Dry or granular products can also be arranged in the form of a twirl on the contents of a food pot.

BACKGROUND OF THE INVENTION

In order to fill a food pot with this type of food product, the known devices comprise a plurality of food product-dispensing nozzles which are arranged above the pots and in which each nozzle is intended to fill one pot.

For example, for packaging a set of pots in two rows of four pots each, the filling device comprises eight nozzles arranged in two rows of four nozzles.

The nozzles are all mounted on a common plate connected to means capable of moving said plate.

These means for removing the plate are configured to allow a vertical translational movement of the plate in order to lower or raise all of the nozzles above the pots.

These means for moving the plate are also configured to allow a rotational movement of the plate so that all of the nozzles rotate about the axis of translation of the plate.

The existing devices operate as follows.

In order to fill the pots, the nozzles mounted on the plate are first brought within the pots. The position adopted is then a bottom position.

Then, the filling operation itself is carried out as the plate, and therefore all of the nozzles, rises from the bottom position to a top position known as the release position.

The opening of the nozzles is controlled from the bottom position and throughout the filling in order to allow the product to be metered.

In the top release position, and sometimes a bit before, the closing of the nozzles is controlled, for example by valves which shut off the supply of the nozzles, and the device can no longer fill the pot.

Another set of pots can then be brought up, for example packaged in two rows of four pots, in order to begin the preceding steps again.

Moreover, by combining the translational and rotational movements of the plate, the nozzles are able to carry out a filling in the form of a twirl, for example of a whipped cream-type food product for a café liégeois ice cream.

Indeed, this merely requires the plate to be raised, during the phase for filling the pot, along its axis of translation while at the same time imparting thereto a rotational movement about this axis.

The known devices based on this principle have variant embodiments.

For example, certain devices are equipped with nozzles each having a single supply channel. These devices therefore fill a pot with a single food product.

Other, more sophisticated devices are equipped with nozzles each comprising two independent channels. Each of these channels can be supplied with a different product in such a way that it is possible to fill a pot with two different food products.

However, whatever the variants proposed, the known devices are all based on the use of a plate on which all of the nozzles are mounted, to which plate translational movements are directly imparted, optionally combined with rotational movements.

These devices lead to a plurality of drawbacks.

That is to say, the plate comprising all of the nozzles is a heavy element displaying considerable inertia that does not allow precise management of the translational and above all rotational movements that have to be imparted to the nozzles.

Moreover, in so far as an identical movement is applied to all of the nozzles via the plate, it is not possible to fill pots within the same set of pots with different products. For example, in order to make a café liégeois ice cream, the twirl shape which is produced with the product is the same for all the pots.

Furthermore, for devices equipped with nozzles having a single channel, it is necessary to multiply the nozzles and/or the filling stations in order to fill a pot with various products. For example, for café liégeois ice cream, it is necessary to provide a first station for filling the cream coffee, then a second station specifically for filling the twirl-shaped whipped cream.

This greatly lengthens the production time, and therefore increases costs, and makes the device bulkier. Moreover, there are fewer possibilities for mixing products in the pot, given the sequence of filling stations.

There are devices equipped with nozzles each comprising two independent parallel channels which can be supplied simultaneously. However, these devices are very bulky, making them in some cases difficult to reconcile with the width of a pot.

BRIEF SUMMARY OF THE INVENTION

The invention seeks to overcome the aforementioned drawbacks of the existing devices.

For this purpose, the invention proposes a device for filling food pots, for example yoghurt pots, comprising a plurality of nozzles for filling the pots with a food product, said nozzles each being mounted in a nozzle body, characterized in that the device comprises means for applying to each of the nozzles a translational movement along the axis A of the nozzle, optionally combined with a rotational movement about this axis, independently of the nozzle body, in such a way that the same nozzle can both carry out the filling action and stop the filling.

This device also has at least one of the following characteristics, taken in isolation or in combination:

the nozzle bodies form part of a first set E1 also comprising:

- a cylinder body having a vertical axis;
- a plate mounted on the cylinder body and extending perpendicularly to the axis of the cylinder body;
- a support fixed to the plate and extending perpendicularly to this plate, the nozzle bodies all being fixed to the support;

the nozzles form part of a second set E2 also comprising:

- a rod capable of being vertically translated in the cylinder body;
- a plate mounted on the rod and extending perpendicularly relative to this rod;

a plurality of actuators mounted by a first end along the plate, each actuator being mounted by a second end on a nozzle and extending along the axis A of this nozzle;

the second set E2 is capable of being displaced in a translational movement relative to the frame of the device;

the first set E1 is capable of being displaced in a translational movement relative to the frame of the device;

the second set E2 is capable of being displaced in a translational movement relative to the first set E1, via the displacement of the rod in the cylinder body;

the device provides a system, comprising for example one or more belt(s), for rotating the actuators;

the system for rotating the actuators is configured in such a way that the nozzles display a common movement or a movement which is independent of the other nozzles;

the device provides a plurality of actuators, each actuator being mounted by one end on a nozzle and extending along the axis A of this nozzle in order to transmit to the nozzle a translational movement along the axis A of the nozzle, optionally combined with a rotational movement about this axis, independently of the other nozzles;

the actuators transmit to each of the nozzles a combined translational movement along the axis A of the nozzle and rotational movement about this axis, wherein the rotational movement is also carried out independently of the other nozzles;

the nozzles are made of ceramic, of thermoplastic material, of thermosetting material or of fluoropolymer;

the nozzle bodies are made of a similar material to the associated nozzle, namely of ceramic, of thermoplastic material, of thermosetting material or of fluoropolymer as appropriate;

each nozzle comprises at least two independent channels capable of being supplied with different food products;

the nozzle bodies comprise peripheral grooves for supplying the associated nozzle with food product, each nozzle body comprising a number of peripheral grooves equal to the number of supply channels of the nozzle;

the supply mouths of the supply channels of the nozzle, on the one hand, and the peripheral grooves of its nozzle body, on the other hand, are spaced relative to one another in such a way that each supply mouth faces a peripheral groove in a filling position of the device, allowing in particular the simultaneous filling of different products, and that the supply mouths of the channels are offset relative to the peripheral grooves in a release position of the device;

each nozzle body comprises a plurality of peripheral grooves for supplying a channel of the nozzle;

the device provides a tank for cleaning the nozzles, the tank being arranged below the nozzles and being capable of being translated in the direction of the nozzles in order to bring the device into a cleaning position.

The invention also proposes a method for filling food pots, for example yoghurt pots, characterized in that it includes a step consisting in filling pots by applying to each of the nozzles of a device according to the invention a translational movement along the axis A of the nozzle, optionally combined with a rotational movement about this axis, independently of the nozzle body, in such a way that the same nozzle can both carry out the filling action and stop the filling.

This method also includes at least one of the following steps:

each nozzle (10) is positioned in what is known as a bottom position of the device in which the nozzle is above or within a pot;

in order to fill the pot, each nozzle (10) is translated relative to the pots along the axis (A) of the nozzle, optionally in combination with a rotational movement about this axis, in the direction of what is known as a top position of the device;

in order to stop the filling, each nozzle (10) is translated from the top position of the device to what is known as a release position.

Furthermore, the method can include a filling step wherein the food pots are moved or the food pots are held stationary.

BRIEF DESCRIPTION OF THE SEVERAL VIEWS OF THE DRAWING(S)

Figure 1A:
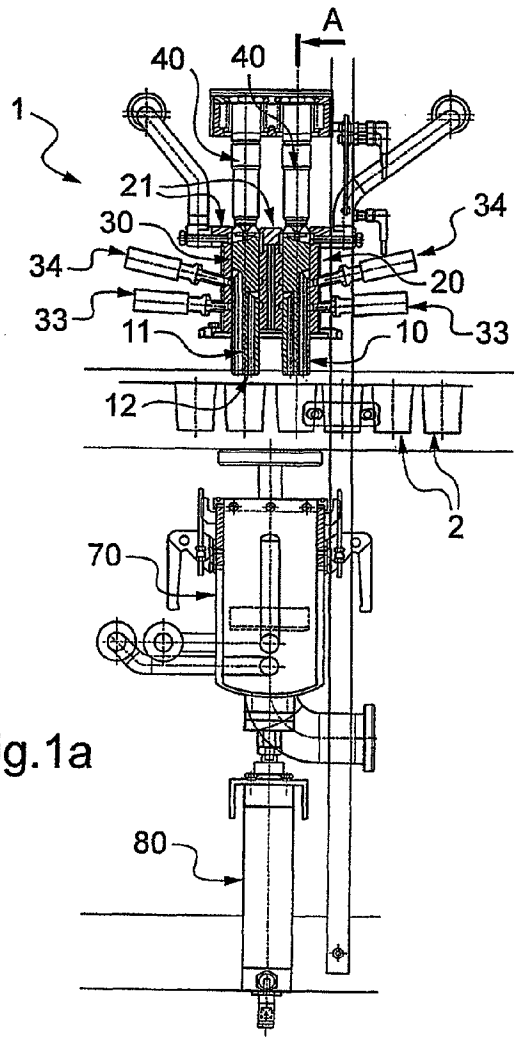
Figure 2B:
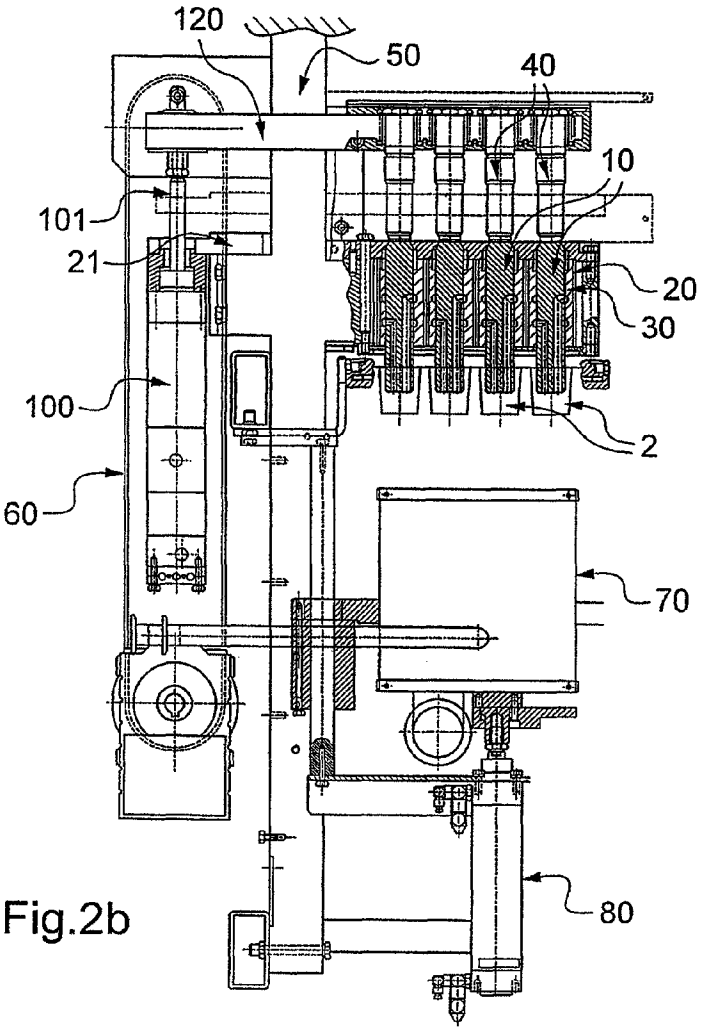
Figure 2A:
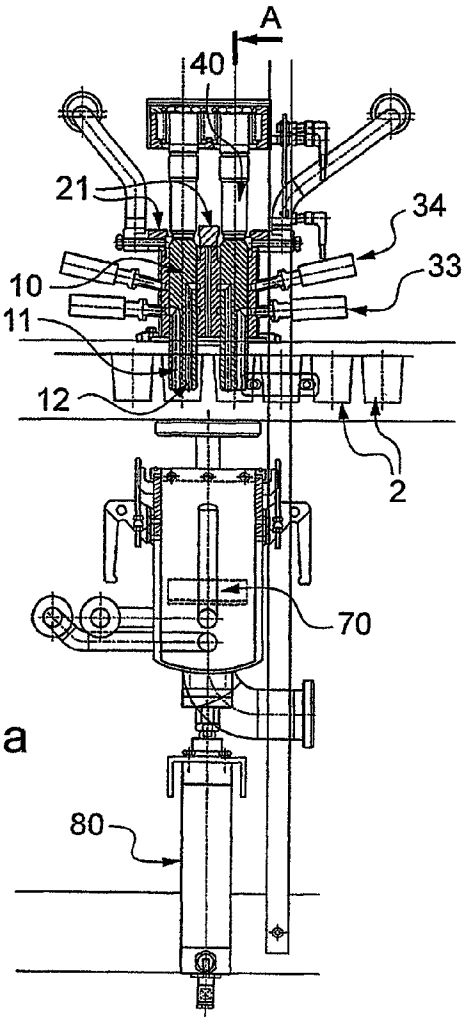
Figure 3B:
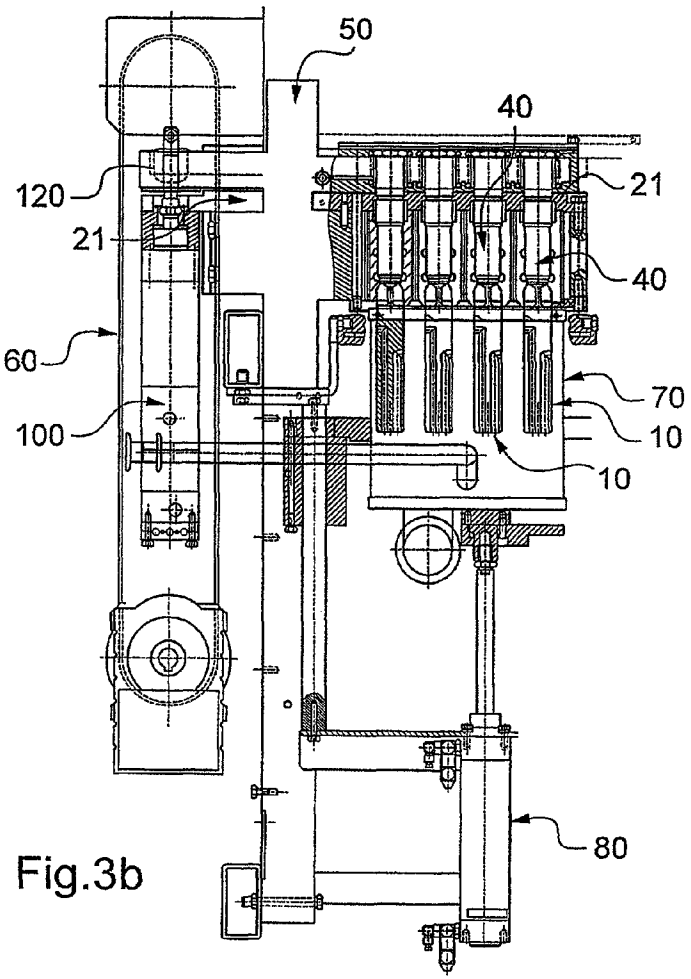
Figure 3A:
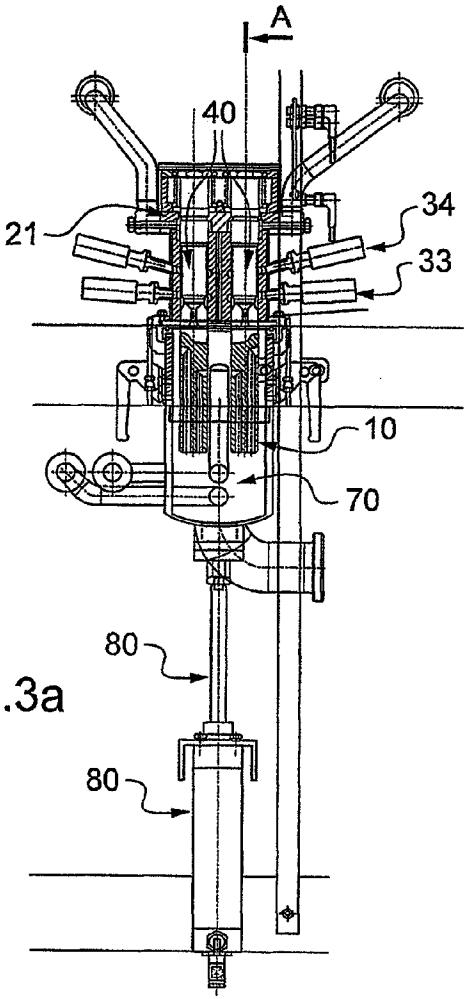
Figure 6:
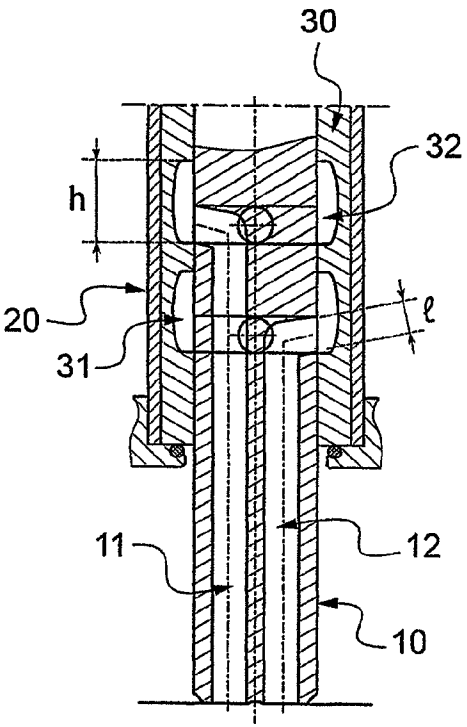
Figure 4:
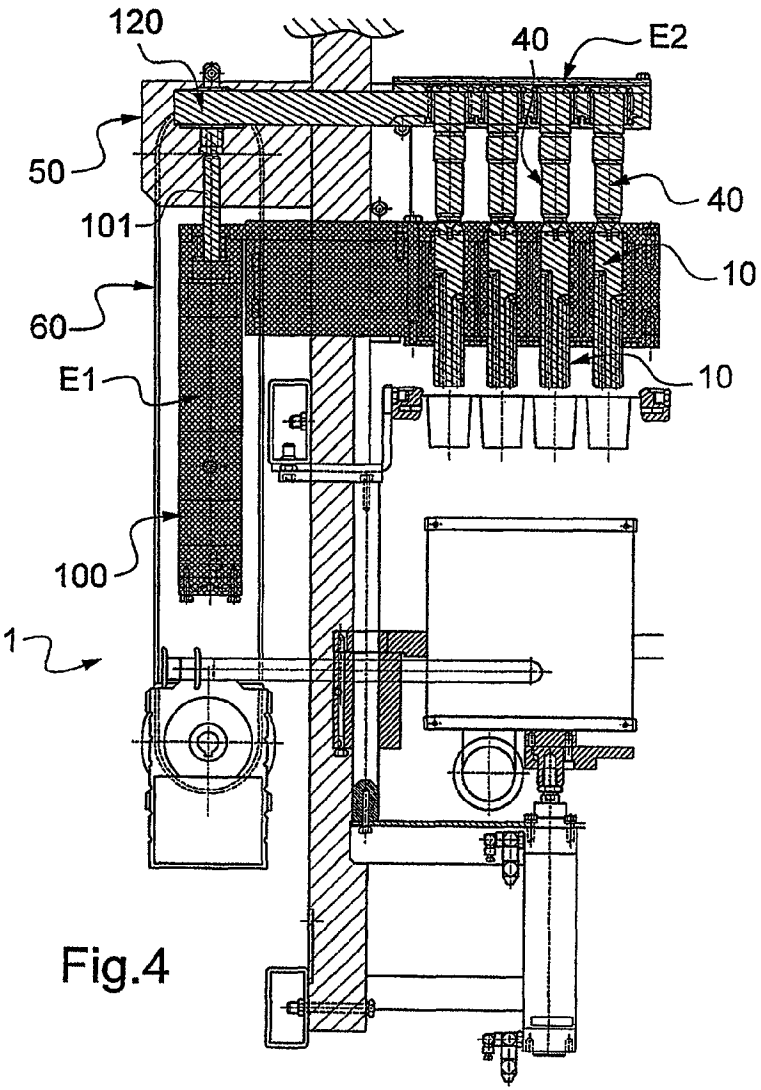
Figures 5A, 5B, 5C:
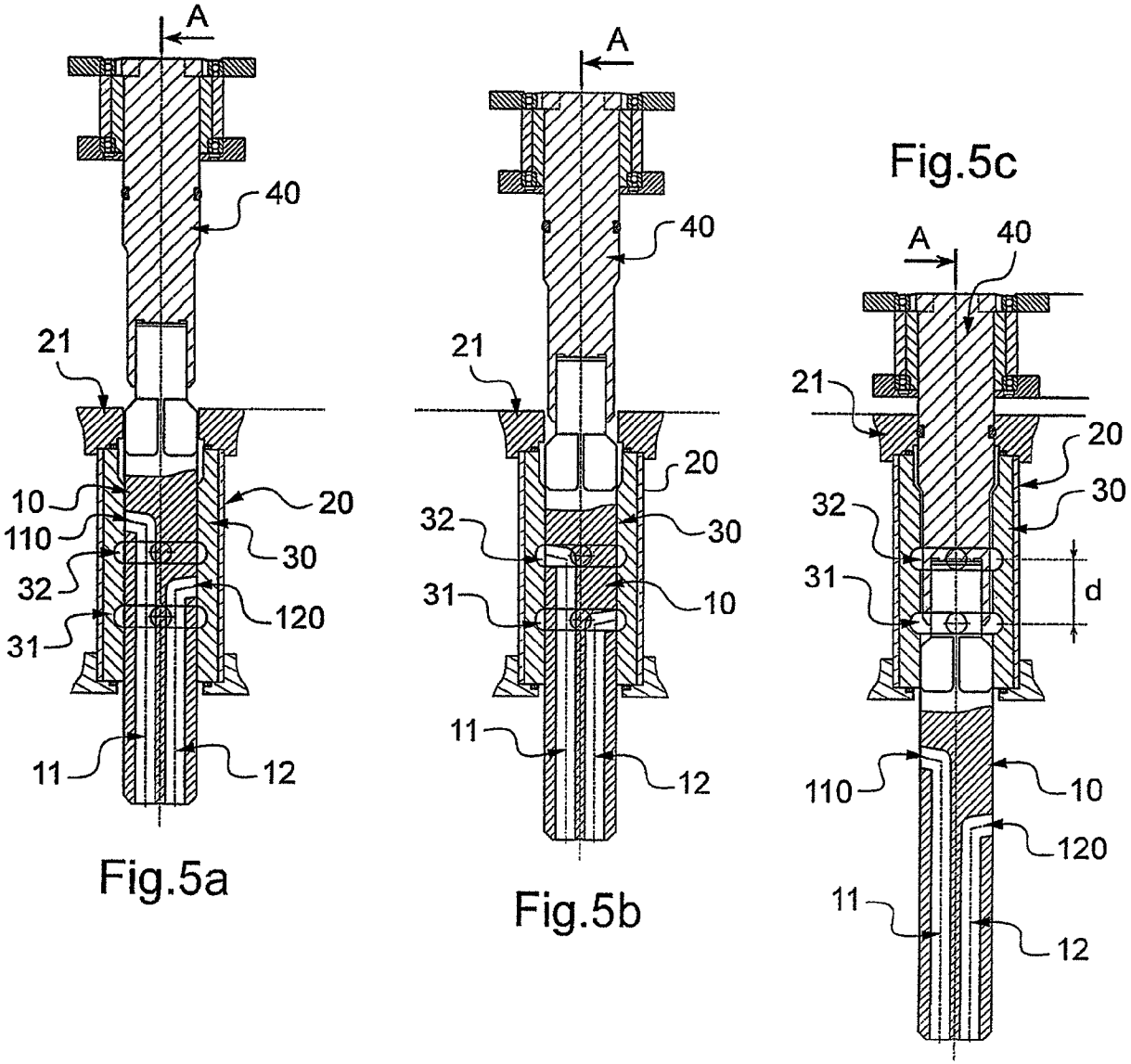

The invention will be better understood and other objects, advantages and features thereof will become clearer on reading the following description given with reference to the appended drawings, in which:

FIG. 1 comprises FIGS. 1(*a*) and 1(*b*) showing, in a side view and in a front view respectively, a device for filling food pots according to the invention, in a release position;

FIG. 2 comprises FIGS. 2(*a*) and 2(*b*) showing, in a side view and in a front view respectively, a device for filling food pots according to the invention, in a bottom position of the food pots;

FIG. 3 comprises FIGS. 3(*a*) and 3(*b*) showing, in a side view and in a front view respectively, a device for filling food pots according to the invention, in a cleaning position;

FIG. 4 shows the device for filling food pots from FIG. 1(*b*) showing three sets capable of being displaced in translation relative to one another;

FIG. 5 comprises FIGS. 5(*a*), 5(*b*) and 5(*c*) showing a nozzle according to the invention in longitudinal section, respectively in three positions of the device, namely the release position, the bottom position and the cleaning position; and FIG. 6 is a longitudinal section of a variant embodiment of a nozzle according to the invention in the bottom position.

DETAILED DESCRIPTION OF THE INVENTION

A device according to the invention is shown in FIGS. 1 to 4.

The device 1 shown in these FIGS. 1 to 4, has three main positions, namely the release position, the bottom position and the position for cleaning the device.

The release position is shown in FIGS. 1, 4 and 5(*a*). In this position, the food pots 2 are remote from the device 1 and the device cannot fill said food pots with any food product.

The bottom position is shown in FIGS. 2 and 5(*b*). In this position, the food pots 2 are arranged close to the device and the device is able to fill said pots.

Finally, the cleaning position is shown in FIGS. 3 and 5(*c*). In this position, there is no food pot facing the device, so that the cleaning means to be described hereinafter can clean the device.

In the configurations illustrated in the appended drawings, the device is intended to fill two rows of four pots.

The food pots 2 in question may for example be yoghurt pots.

The device 1 for filling food pots according to the invention comprises a plurality of nozzles 10 for filling said pots with a food product, wherein a nozzle 10 is associated with the filling of a single food pot.

Each nozzle is arranged above a pot 2 and can undergo a vertical reciprocating movement between the interior of the pot and the top of the pot.

The nozzles 10 have a shape generated by revolution, for example a cylindrical shape.

The nozzles are all mounted on a support 20, via a nozzle body 30 associated with each nozzle.

Each nozzle 10 is movably mounted in its nozzle body 30. For this purpose, the nozzle body 30 has a shape generated by revolution that is compatible with the shape of the nozzle 10 that it encompasses.

The nozzle bodies 30 can be mounted by shrink fitting in the support 20 or by screwing to this support 20. They are therefore integral with the support 20.

However, preference will be given to mounting by shrink fitting which reduces the water retention areas during cleaning of the device. It will be understood that a screwing solution displays screws, nuts, etc. which are equally water stagnation areas.

The support 20 is, moreover, fixed to a plate 21 which is common to all of the nozzle bodies 30.

In order to provide the reciprocating movement of the nozzles 10 above the food pots 2, the device 1 comprises means for applying a vertical movement to the nozzles 10.

The means for applying a vertical movement to the nozzles 10 comprise two sets E1, E2 of parts which will be described in detail.

Indeed, the means for applying a vertical movement to the nozzles 10 comprise a first set E1 of parts moved by an actuating means 60, consisting for example of a belt powered by an electric motor (not shown), of the set E1.

The set E1 comprises a cylinder body 100 having a vertical axis, the plate 21, the support 20 and the nozzle bodies 30. The parts of the set E1 are connected to each other, so that the actuating means 60 commonly displaces the various elements of the set E1. There is therefore no relative movement between the various parts of the set E1. The actuating means 60 generates a vertical translational movement of the set E1 relative to the frame 50 of the device 1.

In this set E1, the axis of the cylinder body is vertical, the plate 21 extends perpendicularly to the axis of the cylinder body 100 and the support 20 extends perpendicularly to the plate 21.

The nozzles 10 do not form part of the set E1, in so far as each nozzle 10 can be displaced in its nozzle body 30.

The nozzles 10 are therefore not fixed to the plate 21, unlike in the existing devices.

However, even so, the device 1 can allow the nozzles 10 to be displaced in a common movement with the translational movement applied to the set E1 by the actuating means 60.

Indeed, the means for applying a vertical movement to the nozzles 10 also comprise a second set E2 of parts which can be displaced in a vertical translational movement relative to the set E1, but which can also follow the set E1 in its movement relative to the frame 50.

The nozzles form part of the second set E2 which also comprises:

- a rod 101;
- a plate 120 mounted on the rod 101 and extending perpendicularly relative to the rod 101;
- a plurality of actuators 40 extending perpendicularly relative to the plate 120 and mounted by a first end along said plate, each actuator being, moreover, mounted by a second end on a nozzle 10 and extending along the axis A of the nozzle 10.

The set E2 is situated above the set E1 so as to allow the actuators 40 to act directly on each nozzle 10.

The rod 101, the plate 120, the actuators 40 and the nozzles are connected to each other.

The rod 101 is the element of the set E2 that allows the set E2 to be translated relative to the set E1. That is to say, the rod 101 is that of the cylinder consisting of the cylinder body 100 and said rod 101.

Consequently, it will be understood that the translational movement of the set E2 relative to the set E1 is a translational movement in the same direction as the translational movement applied by the actuating means 60 to the set E1. The translational movement of the set E2 relative to the set E1 is therefore a vertical movement.

Each actuator 40 is associated with a single nozzle 10. The device 1 therefore comprises as many actuators 40 as nozzles 10. Each actuator 40 thus allows the translational movement along the axis A of the nozzle to be transmitted directly to the associated nozzle, independently of its nozzle body 30, i.e. without passing via the plate 21.

The axis A of the nozzle 10 is an axis of revolution in view of its cylindrical shape. It also corresponds to the axis of revolution of the nozzle body 30 in which the nozzle 10 can be displaced.

The translational movement of the set E2 relative to the set E1 thus allows each nozzle 10 in its nozzle body 30 to be translated via the actuator 40 associated with each nozzle 10. The translational movement of the nozzles 10 in their respective nozzle body 30 is common to all of the nozzles 10, in so far as it is generated by the displacement of the rod 101 (set E2) in the cylinder body 100 (set E1).

In order to fill the pots 2, the device is arranged in the bottom position.

Then, the means 60 is actuated in order to cause the set E1 to rise along the axis of the frame 50 in the direction of the release position. During this operation, the set E2 is not displaced relative to the set E1, but follows the movement of the set E1. Consequently, the nozzles 10 are not displaced in their respective nozzle body 30 during this filling operation.

Once the filling operation has been carried out, the set E2 is translated relative to the set E1 in order to place it in the release position. This translation allows the arrival of food product in the nozzles 10 to be stopped, by translation of each nozzle 10 in its associated nozzle body 30, via each corresponding actuator 40.

The device 1 also allows the nozzles 10 to be rotated about their axis A owing to the actuators 40.

For this purpose, the device 1 provides for example a system (not shown) accommodated in the plate 120 and comprising a belt and pinions, acting on all of the actuators. In this case, the rotational movement imparted to the actuators 40 is a common movement.

Unlike in the existing devices, the device according to the invention does not apply a combined translational and rotational movement about the axis of translation (twirling movement) to the plate 21 which is integral with the nozzle bodies 30, but applies a movement directly to each of the nozzles 10, independently of the nozzle bodies 30.

This allows easier management of the movement to be imparted, in particular with regard to questions of inertia. Furthermore, that allows a plurality of twirls to be produced without the risk of winding of the pipes (not shown) for supplying the products to be metered.

The configuration of the device according to the invention opens up numerous possibilities.

That is to say, it is conceivable to integrate a system within the device 1 allowing each actuator 40 to be acted on independently in such a way that the rotational movement imparted to each nozzle 10 is monitored independently of the rotational movement imparted to the other nozzles. For this purpose, it is conceivable to utilize a plurality of belts, one belt acting on a single actuator 40.

According to this variant, there is applied, during the operation for filling the food pots, a vertical translational movement of the nozzles that is common to all of the nozzles, and a rotational movement of each nozzle about this vertical axis that can be independent from one nozzle to another.

According to this variant, it is therefore possible to communicate a twirling movement to the food product filling a pot from a set of pots that differs from the twirling movement applied to a food product filling another pot from this set.

This variant embodiment offers many more possibilities than the known devices.

It is also conceivable to integrate into the device a system allowing each actuator 40 to impart a translational movement to each nozzle 10 in its nozzle body 30, independently of the other nozzles. This embodiment will be described in detail in the remainder of the description.

Moreover, it will be understood that the translational or twirling movement of each nozzle 10 is carried out in the associated nozzle body 30.

Therefore, in order to limit friction between the nozzle 10 and its nozzle body 30, the materials selected are preferably identical and in any case adapted such as ceramic, thermoplastic materials, thermosetting materials or else fluoropolymers.

Indeed, the twirling movement applied to each of the nozzles 10 is carried out very rapidly, for example over a period of a few seconds, in a permanent reciprocating movement, causing heating and wear.

Now, the proposed materials have the benefit of displaying good heat resistance and of reducing friction.

Moreover, these materials are also chemically neutral, hard, display good wear resistance and comply with food standards.

Preferably, the nozzles 10 and the nozzle bodies 30 will however be made of ceramic.

The reason for this is that ceramic displays low wear and allows the maintenance, despite intensive use of the device, of very precise tolerance ranges of the order of from 1 to 5 μm, on account of its low coefficient of thermal expansion.

Moreover, clearances with tolerance ranges of this type are sufficient to ensure an appropriate tightness between a nozzle 10 and its nozzle body 30.

There is therefore no risk of the food product being introduced into the annular space situated between the nozzle 10 and its nozzle body 30.

In the existing devices, there is no movement between a nozzle and its nozzle body. Therefore, use is most often made of a seal, made for example of elastomer material, arranged between the nozzle and the nozzle body in order to perform this tightness function.

However, the use of such a seal is inconceivable as soon as there is a translational and/or rotational movement of the nozzle in the nozzle body, as within the invention. The reason for this is that the seal would be very rapidly destroyed by the repeated high-frequency translational movements, optionally combined with rotational movements.

An actuator 40 may for example, but without limitation, be a cylinder having multiple positions, more precisely having three positions. In this case, it is well suited to obtain the release, bottom and cleaning positions.

Indeed, the various positions of the device 1 (release, bottom, cleaning) are associated with various respective positions of a nozzle 10 and of its nozzle body 30. This will be explained in greater detail in the remainder of the description.

A nozzle 10 and its nozzle body 30 employed in the device according to the invention shown in FIGS. 1 to 4 will now be described with reference to FIG. 5.

Each nozzle 10 comprises at least two independent channels capable of being supplied with different food products.

The various appended figures show two independent channels 11, 12. However, the person skilled in the art will understand that it is possible to provide a single channel for each nozzle or else more than two independent channels for each nozzle.

These independent channels 11, 12 enable the nozzle 10 to fill a pot with a plurality of food products, so that the number of nozzles and/or of filling stations does not have to be increased in order to fill a pot with various products.

In addition, each channel 11, 12 has a small diameter. Consequently, the overall size of said channels, which are arranged in parallel, remains limited relative to the existing nozzles having a plurality of channels.

Moreover, each nozzle body 30 comprises peripheral grooves 31, 32 extending over the periphery of the internal wall of the nozzle body 30. A peripheral groove thus has the shape of a ring which is open on the internal space of the nozzle body 30.

Each nozzle body 30 comprises a number of grooves 31, 32 equal to the number of supply channels of the nozzle 10.

Thus, a nozzle body 30 will have at least two peripheral grooves 31, 32 arranged one above the other along the internal wall of the nozzle body 30.

However, in a variant, it is possible to provide a plurality of peripheral grooves in the nozzle body 30 for a single channel. This allows the pot to be filled with a plurality of products in successive layers using the same nozzle.

In the release position, the supply mouth 110 of one 11 of the two channels 11, 12 is arranged above the peripheral grooves 31, 32 of the nozzle body 30, while the supply mouth 120 of the other 12 of the two channels 11, 12 is arranged between the two peripheral grooves 31, 32.

It is then not possible to pour any product into the pots 2. Unlike in the known provisions, use is therefore not made of a valve in order to stop the supplying of a nozzle with food product; instead, the nozzle 10 is translated in its nozzle body 30 so that the channels 11, 12 of a nozzle 10 cannot be supplied with food product through the peripheral grooves 31, 32 of its nozzle body 30.

In the bottom position, the channels 11, 12 of a nozzle 10 are arranged facing at least one peripheral groove 31 of the nozzle body 30.

However, preferably, the channels 11, 12 of a nozzle 10 are arranged facing the two peripheral grooves 31, 32 of the nozzle body 30, in such a way that it is possible to fill a pot simultaneously with various products.

This is particularly useful when it is desirable, for example, to fill a pot of yoghurt with a mixture of two different flavours or to form various compartments within the pot.

For this purpose, the distance d, taken along the direction of the axis of revolution of the nozzle body 30, separating the two peripheral grooves 31, 32 is equal to the distance separating the supply mouths 110, 120 of the two channels 11, 12 of the nozzle 10.

During a filling operation, the peripheral grooves 31, 32 bring the food products up to the channels 11, 12 of the nozzle.

The peripheral grooves 31, 32 are themselves supplied through reservoirs (not shown) outside the device, to which they are connected via dispensing means 33, 34.

The simultaneous supplying of the two channels 11, 12 allows time to be saved when filling the food pots, when it is desirable to fill the pots with mixtures of flavours.

The filling operation therefore consists in translating the sets E1 and E2 into the bottom position, then in carrying out the filling by translating these two sets E1 and E2 in an identical manner upward, optionally in combination with a rotational movement of the nozzles with a desired number of turns, then, once the filling has been carried out, in positioning the nozzles in the release position in order to stop the filling by a translational movement of the set E2 relative to the set E1. This relative translational movement of the two sets E1, E2 leads to a relative movement of the nozzles in their nozzle bodies 30 and to shutting-off of the supply channels 11, 12 of each nozzle 10.

The translational path imparted by the belt 60 to the set E1 and consequently to the set E2 is generally between 50 and 60 mm. Once the filling has been carried out, the translational path linked to the displacement of the set E2 relative to the set E1 must at least correspond to the width of a supply channel 11, 12 of the nozzle in order to completely shut off these channels 11, 12. For example, this path can be approximately 15 mm.

Moreover, the twirling movement capable of being carried out from the bottom position causes the nozzle 10 to turn about itself, for example, by one and a quarter turns. However, a greater or lesser rotation than this would also be conceivable.

For this filling operation, it would also be conceivable for there to be a plurality of filling passes, one pass consisting in passing from the bottom position to the release position.

A variant embodiment of a nozzle body 30 is shown in FIG. 6.

The nozzle body shown in this figure must in particular be utilized when it is desirable for the filling operation to be carried out by a displacement of each nozzle 10 in its nozzle body 30, that is to say either by a displacement of the set E2 relative to the set E1 or by direct actuation of the actuators 40.

More specifically, the dimensions of the height h of the grooves 31, 32 are for example such as to cover the translational path of each nozzle 10 in its nozzle body 30 during an operation for filling a pot 2. For this reason, the height h of a groove 31, 32 is greater than the width 1 of a supply channel 11, 12 of the nozzle 10.

According to this variant, the operation of the device shown in FIGS. 1 to 4 is modified in so far as the displacement of the set E1 relative to the frame 50 may be dispensed with.

For this purpose, means can for example be provided for fixing the set E1 to the frame 50 in such a way as to prevent any movement between the two. It is also possible to provide, from manufacture of the device, rigid mounting of the set E1 relative to the frame 50.

The path taken by the device 1 during a filling operation, up to the release position, is then taken by the single path of the nozzle 10 in its nozzle body 30, which path is generated by the vertical translational movement of the set E2 relative to the set E1.

This translational movement remains common to all of the nozzles 10, since it is dependent on the movement of the rod 101 in the cylinder body 100.

Moreover, the device thus modified can retain all its other characteristics as presented hereinbefore. In particular, it can provide means allowing imparting of a rotational movement of each nozzle 10 about its axis A that is common to or independent of that which is imparted to the other nozzles.

It is also possible to modify the device somewhat more so that the translational movement of each nozzle 10 in its nozzle body 30 is no longer common to all of the nozzles, but independent from one nozzle to another.

In order to achieve this, it is necessary for the vertical translational movement of each actuator 40 of a nozzle 10 to be independent of the vertical translational movement applied to another actuator 40.

For this purpose, means can for example be provided for fixing the plate 120 to the frame 50 in such a way that the second set E2 is also fixed relative to the frame 50, as is the first set E1. In this case, the device provides means for displacing the actuators 40 relative to the plate 120. For example, the actuators 40 can be independently powered electric or electromechanical actuators.

Moreover, it is conceivable for the actuators 40 to apply to each of the nozzles 10 a combined translational movement along the axis A of the nozzle and rotational movement about this axis, in which the rotational movement is also carried out independently of the other nozzles. One possibility is to provide, as mentioned hereinbefore, a belt for rotating by the actuator 40. It would also be possible to provide electromechanical or electric actuators capable of imparting a rotational movement.

These developments of the device are conceivable only in so far as the device according to the invention provides means for moving each nozzle independently of the other nozzles.

Whatever the variant embodiment conceived of, the device 1 provides a tank 70 for cleaning the nozzles 10 that is arranged below said nozzles. The cleaning tank 70 is capable of being translated upward in the direction of the nozzles in order to bring the device into its cleaning position.

In this position, the person skilled in the art will understand that there are no food pots between the cleaning tank 70 and the nozzles 10.

In the cleaning position, the tank 70 is in the highest position, whereas each nozzle 10 is in its lowest position, for which the nozzle 10 is extracted from its nozzle body 30.

In this position, the channels 11, 12 of each nozzle 10 are thus immersed in the cleaning product contained in the tank 70.

The cleaning tank 70 is for example displaced with the aid of a cylinder 80, in a direction identical to the direction of translation of the nozzles.

The operation of the device 1 can be summarized by following the behaviour of a nozzle 10 of this device.

When the device 1 is in the release position, the nozzle 10 is in its highest position and the channels 11, 12 of the nozzle 10 are not arranged facing the peripheral grooves 31, 32 of the nozzle body 30. No food product can be poured into the pots.

Then, in order to fill a pot, the nozzle 10 is displaced downward to the bottom position of the device. The channels 11, 12 of the nozzle 10 are then arranged facing the peripheral grooves 31, 32 of the nozzle body 30. In the bottom position, the nozzles can be positioned above or within the pots.

The operation for filling the pots starts and consists in a movement of the nozzle 10 relative to the pots 2 in the direction of a high position of the device.

Depending on the individual case, the movement in question is either a translational movement along the axis of the nozzle or a twirling movement about this axis. Returning to the example of café liégeois ice cream, the food pots are then filled with a coffee cream by carrying out a translational movement of the nozzles 10 relative to the pots and the filling operation is repeated, this time with a whipped cream, by carrying out a twirling movement.

Moreover, the pots can be held stationary during the filling step. In a variant, said pots can be moved.

In order to stop the filling, the nozzle 10 is translated from the high position of the device to the release position, which is the highest position of the nozzle.

When the release position has been reached, a new set of pots can be brought up, and the steps mentioned hereinbefore are then repeated.

Once the production of food pots has been finished, or when it is desirable to change the nature of the various food products, the device 1 is placed in the cleaning position.

The invention claimed is:

1. Device for filling food pots comprising a plurality of nozzles for filling the pots with a food product, said nozzles each being mounted in a nozzle body wherein the device comprises means for applying to each of the nozzles a translational movement along a vertical axis (A) of the nozzle, optionally combined with a rotational movement about this axis, independently of the nozzle body, so that the nozzle enables the filling of the pots or the stop of the filling depending on its position in the nozzle body, in such a way that the same nozzle can both carry out the filling action and stop the filling, wherein the nozzle bodies form part of a first set E1 and a second set E2, wherein the first set E1 comprises:

a cylinder body having a vertical axis;

a plate mounted on the cylinder body and extending perpendicularly to the axis of the cylinder body;

a support fixed to the plate and extending perpendicularly to this plate, the nozzle bodies all being fixed to the support, and the second set E2 comprises:

a rod capable of being vertically translated in the cylinder body;

a plate mounted on the rod and extending perpendicularly relative to this rod;

a plurality of actuators mounted by a first end along the plate, each actuator being mounted by a second end on a nozzle and extending along the axis (A) of this nozzle.

2. Device for filling food pots according to claim 1, wherein the second set E2 is capable of being displaced in a translational movement relative to a frame of the device.

3. Device for filling food pots according to claim 1, wherein the first set E1 is capable of being displaced in a translational movement relative to a frame of the device.

4. Device for filling food pots according to claim 1, wherein the second set E2 is capable of being displaced in a translational movement relative to the first set E1, via the displacement of the rod in the cylinder body.

5. Device for filling food pots according to claim 1, wherein a system is provided, comprising one or more belt(s) for rotating the actuators.

6. Device for filling food pots according to claim 5, wherein the system for rotating the actuators is configured in such a way that the nozzles display a common movement or a movement which is independent of the other nozzles.

7. Device for filling food pots comprising a plurality of nozzles for filling the pots with a food product, said nozzles each being mounted in a nozzle body wherein the device comprises means for applying to each of the nozzles a translational movement along a vertical axis (A) of the nozzle, optionally combined with a rotational movement about this axis, independently of the nozzle body, so that the nozzle enables the filling of the pots or the stop of the filling depending on its position in the nozzle body, in such a way that the same nozzle can both carry out the filling action and stop the filling, wherein a plurality of actuators are provided, each actuator being mounted by one end on a nozzle and extending along the axis (A) of this nozzle in order to transmit to each of the nozzles a combined translational movement along the axis (A) of the nozzle and a rotational movement about this axis, wherein the rotational movement is also carried out independently of the other nozzles.

8. Device for filling food pots according to claim 1, wherein the nozzles are made of ceramic, of thermoplastic material, of thermosetting material or of fluoropolymer.

9. Device for filling food pots according to claim 1, wherein the nozzle bodies are made of ceramic, of thermoplastic material, of thermosetting material or of fluoropolymer as appropriate.

10. Device for filling food pots according claim 1, wherein each nozzle comprises at least two independent channels capable of being supplied with different food products.

11. Device for filling food pots according claim 10, wherein the nozzle bodies comprise peripheral grooves for supplying the associated nozzle with food product, each nozzle body comprising a number of peripheral grooves equal to the number of supply channels of the nozzle.

12. Device for filling food pots according to claim 11, wherein each supply channel of the nozzle includes a corresponding supply mouth, and wherein each supply mouth on the one hand, and the peripheral grooves of its nozzle body, on the other hand, are spaced relative to one another in such a way that each supply mouth faces a peripheral groove in a filling position of the device, allowing in particular the simultaneous filling of different products, and that the supply mouths of the channels are offset relative to the peripheral grooves in a release position of the device.

13. Device for filling food pots according to claim 1, wherein each nozzle body comprises a plurality of peripheral grooves for supplying a channel of the nozzle.

14. Device for filling food pots according to claim 1, wherein a tank is provided for cleaning the nozzles, the tank being arranged below the nozzles and being capable of being translated in the direction of the nozzles in order to bring the device into a cleaning position.

15. Method for filling food pots, for example yoghurt pots, characterized in that it includes a step consisting in filling pots by applying to each of the nozzles of a device according to claim 1, a translational movement along the axis (A) of the nozzle, optionally combined with a rotational movement about this axis, independently of the nozzle body, in such a way that the same nozzle can both carry out the filling action and stop the filling.

16. Method for filling food pots according to claim 15, wherein the following steps are carried out:

each nozzle is positioned in a bottom position of the device in which the nozzle is above or within a pot;

in order to fill the pot, each nozzle is translated relative to the pots along the axis (A) of the nozzle, optionally in combination with a rotational movement about this axis, in the direction of a top position of the device;

in order to stop the filling, each nozzle is translated from the top position of the device to what is known as a release position.

17. Method for filling food pots according to one of claim 15, wherein the food pots are held stationary during this filling step.

* * * * *